United States Patent [19]

Andreasson

[11] Patent Number: 4,706,640

[45] Date of Patent: Nov. 17, 1987

[54] MAGNETIC IGNITION SYSTEM

[75] Inventor: Bo C. Andreasson, Göteborg, Sweden

[73] Assignee: AB Electrolux, Sweden

[21] Appl. No.: 885,408

[22] Filed: Jul. 14, 1986

[30] Foreign Application Priority Data

Jul. 19, 1985 [SE] Sweden ..... 8503534

[51] Int. Cl.[4] ..... F02P 1/08

[52] U.S. Cl. ..... 123/651; 123/149 A

[58] Field of Search ..... 123/149 R, 149 A, 149 C, 123/418, 599, 651

[56] References Cited

U.S. PATENT DOCUMENTS 3,894,525 7/1975 Haubner et al. ..... 123/149 R X 4,175,509 11/1979 Orova et al. ..... 123/418

4,188,929 2/1980 Podrapsky et al. ..... 123/599 X 4,233,951 11/1980 Take ..... 123/149 C X 4,509,496 4/1985 Ishida ..... 123/651

*Primary Examiner*—Tony M. Argenbright

*Attorney, Agent, or Firm*—Alfred E. Miller

[57] ABSTRACT

A magnetic ignition system with an ignition coil primary circuit having an ignition switch is controlled by a control switch to break at a given ignition time so that an ignition voltage is induced in the secondary circuit. A signal is delivered by a control circuit between the voltage supply and earth via resistors to a control switch at the ignition time. The control circuit serves the functions of voltage limiting and prevention of double spark (retriggering).

6 Claims, 3 Drawing Figures

MAGNETIC IGNITION SYSTEM

The present invention relates to a contact-free ignition system for an i.c. engine having a magnetic ignition generator generating a primary voltage in the in the form of pulses.

It is known within the art of ignition circuits that magnetic ignition system with a primary ignition coil circuit may have an ignition switch controlled by a control switch to break the primary circuit at a given ignition time, so that an ignition voltage is induced in the secondary winding of the coil. A control signal is delivered by a control circuit between the voltage output of the ignition generator and ground via a voltage divider to a control switch at the ignition time. A point on the voltage curve of the ignition generator is denoted a reference point of the ignition, and a detector senses this point and releases the control signal. By means of this detector and the therewith associated control circuit advantageous properties can be achieved, e.g. ignition time control.

The purpose of the present invention is to provide elements for voltage limitation, temperature compensation and prevention of double ignition in ignition systems of the above kind. In its simpliest form the control circuit comprises a diode and capacitor which during the ascending part of the voltage curve, is charged to a well-defined threshold voltage for the control transistor by which a break signal from this transistor to the ignition transistor arises and breaks the current in the primary curcuit so that ignition voltage is induced.

A couple of embodiments of ignition systems according to the invention will now be described with reference to the accompanying drawing which shows in FIG. 1 a wiring diagram of such a system, FIG. 2 a variation of the system, and in FIG. 3 voltages in the system.

Figure 1:
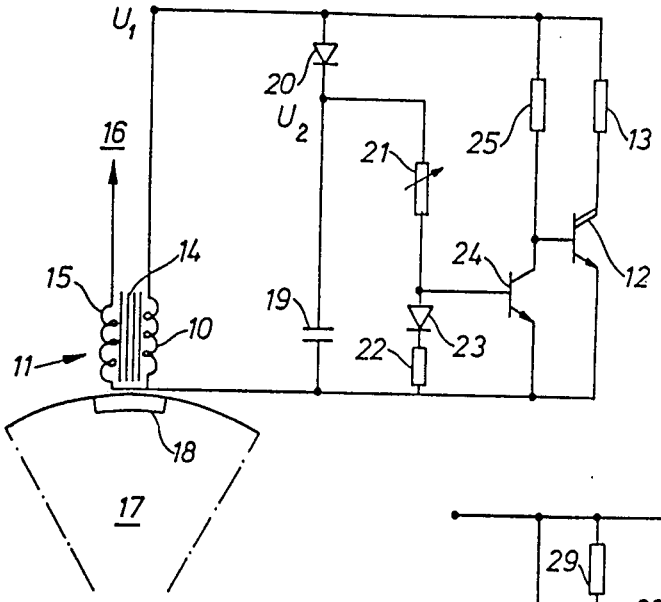

The diagram in FIG. 1 shows an example of the wiring of the ignition system. An ignition energy circuit comprises a primary winding 10 of an ignition coil 11, an ignition transistor 12 of the Darlington type and a limiting resistor 13. The ignition coil has an iron core 14 and secondary winding 15 which supplies a high voltage to a spark plug 16. The iron core is positioned adjacent to the fly wheel 17 of the engine having a permanent magnet 18 which induces a voltage in the winding 10.

Figure 3:
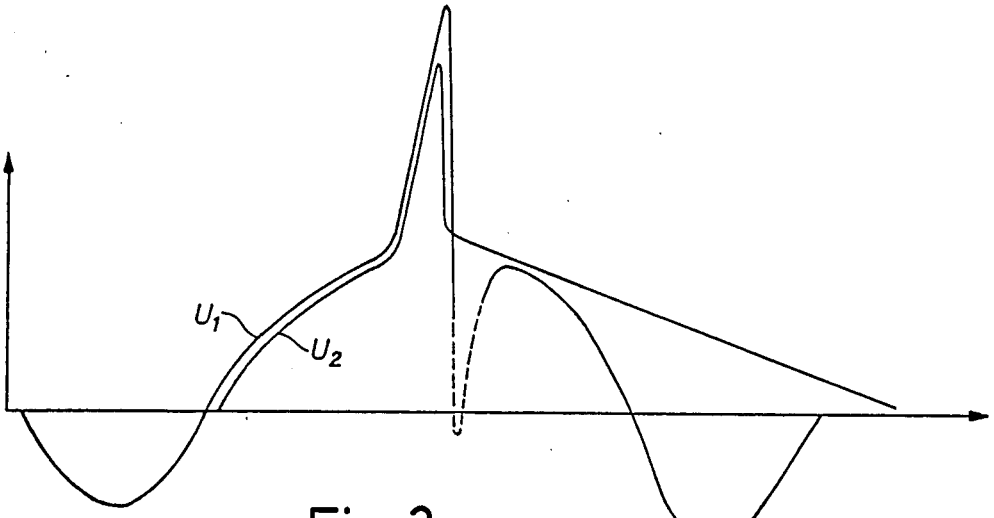

The primary winding supplies an induced voltage $U_1$ according to FIG. 3. A current flows in the ignition energy circuit as soon as the voltage is positive. During the positive voltage a capacitor 19 is charged by a diode 20 in a branch parallel to the resistor 13 and the ignition transistor 12. The capacitor voltage $U_2$ follows the voltage $U_1$ approximately in parallel, since the capacitor is very small. It is connected in parallel with a voltage divider of resistors 21, 22 and a diode 23 which is used for temperature compensation. A control voltage is passed from the voltage divider to the base electrode of a control transistor 24 of NPN-type. At the top of the voltage curve the control voltage reaches a threshold value of the control transistor 24 which then passes current, whereby the base voltage of the ignition transistor 12 decreases. This transistor has been conductive during the prevailing rising part of the voltage curve $U_1$, but is now controlled to be non-conductive so that the primary current in the ignition coil falls to zero and an ignition voltage is induced in the secondary winding 15.

A condition for making circuits of this type work is that the ignition transistor is controlled to saturation. In such a circuit this is achieved by effectively connecting a base resistor 25 in parallel with the resistor 13 in series with the main current path of the ignition transistor. The resistance of the resistor 13 is about 1 ohm and the break current of the circuit is 2–3 A. When the ignition transistor passes current a voltage drop occurs in the series resistor. This voltage drop is used to give the ignition transistor a sufficient base current via the base resistor 25 (about 220–680 ohm). When the primary current increases, the voltage drop across the series resistor will also increase and thus also the base current. Due to the fact that the transistor is controlled to saturation the thermal pressure on the same is decreased.

A problem with circuits of this type is that the voltage on the ignition circuit, the primary voltage, can be so high that the function of the ignition transistor is jeopardized. The circuit should thus include some type of voltage limiting. By the solution of the problem used herein it is easy to connect a capacitor in parallel with the ignition transistor.

Another well known problem in ignition circuits of this type is false triggering, i.e. the ignition procedure is blocked when the spark is released depending on the fact that the primary voltage is periodically negative (shown in FIG. 3 as a downwards directed, dashed tip of the voltage curve).

Both problems, voltage limiting and false triggering, are solved in the circuit shown in FIG. 1 by connecting the diode 20 and capacitor 19 in a series circuit in parallel with the ignition transistor 12. The capacitance of the capacitor is in a range of 10–47 nF and it is charged at every ignition to about 250 V. When the primary voltage is negative or when the primary voltage falls below the capacitor voltage, this charging of capacitor is prevented by the diode.

Since the capacitor voltage exceeds the triggering voltage through the whole ignition procedure false triggering is prevented because the triggering voltage to the control transistor is taken from the capacitor.

Temperature compensation is necessary to keep the break voltage constant in the temperature range during operation. In the present case the temperature compensation has been arranged in a simple, effective and in view of costs advantageous way. The diode 23 in series with the resistor 22 is connected in parallel with the control current path of the control transistor 24. The diode is so selected that it has a lower forward voltage drop than the base-emitter voltage drop of the control transistor. However, the temperature co-efficients of the diode and the control transistor, respectively, are the same. The level of the triggering voltage is thus determinded by the voltage across the capacitor (4 volts at the triggering moment). This voltage is divided by the resistors 21 and 22 so that the voltage on the base of the control transistor is about 0,5 V.

All the included components have tolerances which influence of the level of triggering. By adjusting the resistor 21 which is a potentiometer, when the circuit is in duty, all these tolerances will be compensated.

Figure 2:
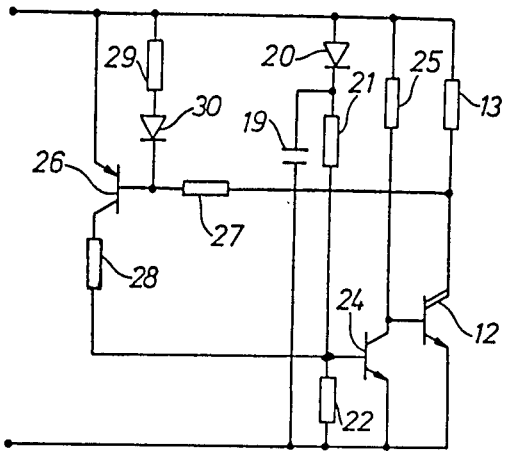

In FIG. 2 essentially the same wiring as in FIG. 1 is reproduced and the corresponding components have the same reference numbers. However, the arrangement is now completed with an extra control circuit including a transistor 26, resistors 27, 28, 29 and a diode 30 for temperature compensation. The control circuit detects the current in the primary circuit as a function of the voltage across the limiting resistor 13. The transistor 26 has, similarly to the control transistor 24, a threshold value, at which it switches from a high resistive state to a low resistive state. The common point of the two control circuits is the base of the control resistor 24. Any one of the control circuits can here first give a base voltage which makes the control transistor low resistive and as soon as it has a low resistance, it will be kept in this state during the rest of the prevailing primary current pulse owing to the discharging of the capacitor 19 through the resistor 22.

The property of voltage limiting as stated in the introduction is provided by the capacitor 19 which restricts the voltage in the primary circuit at breaking of the same. The components are hereby protected from dangerous over-voltage. Moreover, the arrangement of the capacitor has such an effect that the control transistor 24 during the rest of the pulse after the ignition is low resistive as the capacitor is discharged and gives a control current. A feedback between the transistors, resulting in double ignition, is thereby avoided.

What is claimed is:

1. In a magnetic ignition system for an internal combustion engine, wherein the ignition system comprises an ignition coil having a primary winding and a secondary winding, a permanent magnet movable with respect to the coil to generate a pulsatory voltage in the primary winding, an ignition switch having a control electrode and being serially coupled to the primary winding, and a control circuit coupled to said primary winding and to the control electrode of said ignition switch, for maintaining said ignition switch conductive during ascending curve portions of the voltage of said primary winding, the improvement wherein said control switch comprises an amplifier having an output coupled to said control electrode of said ignition switch, said control circuit comprising a series circuit of resistance means and rectifying means connected to receive at least a portion of the primary winding voltage of said coil, whereby voltage pulses of said primary winding are developed across said resistance means, means connected to apply voltage pulses from said resistance means to said amplifier, whereby said amplifier blocks said ignition switch at a determined threshold voltage, a capacitor connected in parallel with said resistance means, a limiting resistor connected in series with said ignition switch, and means coupling the voltage across said limiting resistor to the input of said amplifier.

2. The ignition system of claim 1 wherein said amplifier comprises a transistor.

3. The ignition system of claim 1 wherein said means coupling the voltage across said limiting resistor to said amplifier comprises a second amplifier.

4. The ignition system of claim 3 further comprising voltage dividing means for applying the voltage across said limiting resistor to the input of said second amplifier, said voltage dividing means comprising serially connected diode means for temperature compensation.

5. In a magnetic ignition system for an internal combustion engine, wherein the ignition system comprises an ignition coil having a primary winding and a secondary winding, a permanent magnet movable with respect to the coil to generate a pulsatory voltage in the primary winding, an ignition switch having a control electrode and being serially coupled to the primary winding, and a control circuit coupled to said primary winding and to the control electrode of said ignition switch, for maintaining said ignition switch conductive during ascending curve portions of the voltage of said primary winding, the improvement wherein said control switch comprises a transistor amplifier having an output coupled to said control electrode of said ignition switch, said control circuit comprising a voltage divider comprising a series circuit of resistance means and rectifying means connected to said primary winding coil, whereby voltage pulses of said primary winding are developed across said voltage divider, means coupling said voltage divider to the input of said amplifier, whereby said amplifier blocks said ignition switch at a determined threshold voltage, and a capacitor connected in parallel with said resistance means, said voltage divider comprising a series connected thermally responsive resistance means for compensating said system for thermal variation.

6. The system of claim 5 wherein said thermally responsive resistance means comprises a diode.

* * * * *